US008723669B2

(12) United States Patent
Freathy

(10) Patent No.: US 8,723,669 B2
(45) Date of Patent: May 13, 2014

(54) TECHNIQUE FOR DETECTING TRACKING DEVICE TAMPERING

(75) Inventor: Stephen Geoffrey Freathy, Houston, TX (US)

(73) Assignee: Satellite Tracking of People LLC, Houston, TX (US)

( * ) Notice: Subject to any disclaimer, the term of this patent is extended or adjusted under 35 U.S.C. 154(b) by 475 days.

(21) Appl. No.: 12/576,054

(22) Filed: Oct. 8, 2009

(65) Prior Publication Data

US 2010/0090825 A1 Apr. 15, 2010

Related U.S. Application Data

(60) Provisional application No. 61/104,544, filed on Oct. 10, 2008.

(51) Int. Cl.
*G08B 1/08* (2006.01)

(52) U.S. Cl.
USPC ..... 340/539.13; 340/573.4; 455/404.2; 455/456.1

(58) Field of Classification Search
USPC ..... 340/573.4, 539.13, 573.1, 539.11; 455/404.2, 456.1, 456.5, 456.6, 457
See application file for complete search history.

(56) References Cited

U.S. PATENT DOCUMENTS

| | | | | |
|---|---|---|---|---|
| 4,656,463 | A * | 4/1987 | Anders et al. | 340/573.4 |
| 5,731,757 | A * | 3/1998 | Layson, Jr. | 340/539.13 |
| 5,892,447 | A * | 4/1999 | Wilkinson | 340/573.4 |
| 6,100,806 | A * | 8/2000 | Gaukel | 340/573.4 |
| 6,160,481 | A * | 12/2000 | Taylor, Jr. | 340/573.4 |
| 6,239,743 | B1 * | 5/2001 | Lennen | 342/357.63 |
| 2004/0203461 | A1 * | 10/2004 | Hay | 455/456.1 |
| 2008/0316022 | A1 * | 12/2008 | Buck et al. | 340/539.13 |
| 2009/0104869 | A1 * | 4/2009 | Li | 455/1 |
| 2009/0186596 | A1 * | 7/2009 | Kaltsukis | 455/404.2 |

* cited by examiner

*Primary Examiner* — Thomas Mullen
(74) *Attorney, Agent, or Firm* — Novak Druce Connolly Bove + Quigg LLP

(57) ABSTRACT

A technique is disclosed for detecting the presence of a certain form of tampering with respect to the operation of a location tracking device. The tracking device is of the kind that receives signals from which the location of the tracking device is determined and the tampering that is detected is of the kind wherein signal shielding material is placed around the device and/or a signal jamming device is used. In accordance with one aspect of the present invention, the location tracking device includes a metal detector whose output is processed to provide a shielding alarm signal. In accordance with another aspect of the present invention, the gain provided by the AGC circuit in the UPS or other wireless signal receiver within the location tracking device is processed to form a shielding alarm signal. These alarm signals may be distinct so as to distinguish between the different forms of tampering. In addition, either one of these described aspects may be used alone or in combination with one another.

26 Claims, 4 Drawing Sheets

TECHNIQUE FOR DETECTING TRACKING DEVICE TAMPERING

This application claims priority of the U.S. Provisional Patent Application Ser. No. 61/104,544, entitled "Technique for Detecting Tracking Device Tampering", filed on Oct. 10, 2008 which is incorporated by reference herein. This application is also related to concurrently filed U.S. patent application Ser. No. 12/579,090 entitled "Technique for Detecting Tracking Device Tampering Using An Auxiliary Device."

TECHNICAL FIELD

The present invention relates to a system and methodology for detecting tracking device tampering of the type wherein signal shielding material and/or a signal jamming device is used to interfere with the device's ability to receive signals from which the device's location is determined. The subject tracking devices are typically used in a location tracking system wherein each tracking device provides its received signals or its location, derived from such received signals, to a remote monitoring center.

BACKGROUND OF THE INVENTION

In prior art location tracking systems, a tracking device provides its respective location, e.g., its latitude and longitude, or information from which such location can be determined, to a remote monitoring center. At the monitoring center, or some other associated place, the location of the tracking device is determined, if necessary, and then stored and/or processed. To this end, each tracking device receives signals from global positioning system ("GPS") satellites and/or wireless signals from terrestrial antennas, hereinafter "other wireless signals". Each tracking device is typically carried by an entity, hereinafter the "monitored entity", and there may be many different types of monitored entities, including but not limited to, an individual, a moving vehicle, a product, or a product container. The information stored at the remote monitoring center or some other associated location may be used to provide a history of the location of the tracking device and its associated entity as a function of time.

Each tracking device can be implemented as a unitary device, the so-called "one-piece" tracking device, or as multiple devices that communicate with one another. In either case, each tracking device contains a GPS and/or other wireless signal receiver for respectively receiving GPS signals and/or other wireless signals. Either one or both of these signals may be used to determine the location of the tracking device. Further, GPS and other wireless signals may be used at the same time to determine device location or one signal may be used as a backup when the received strength of the other signal is not sufficient. The determination of the device's location may be performed by the device itself or at a remote location. A "dumb" location tracking device is one that merely retransmits the received GPS and/or other wireless signal to a remote location wherein the location of the tracking device is derived from these received signals. A "smart" location tracking device, on the other hand, possesses the capability of deriving its location from the received GPS or other wireless signals and subsequently transmits its determined location to a remote location. In either case, such transmissions to the remote location are typically periodic to reduce consumption of the tracking device's internal battery, but can be immediate, if desired or if one or more prescribed "alarm" conditions are detected. Alarm conditions include, but are not limited to, detection of tracking device tampering, or a determination that the device is located in a prohibited zone, i.e., an "exclusion zone" or that the device is outside of a permitted zone, i.e., a "inclusion zone". Such zones can be set individually to match the requirements for the monitored entity. Smart or dumb tracking devices can be "passive", "active" or a combination thereof. Active location tracking devices communicate their respective location or their received GPS or other wireless signals directly to a remote monitoring station. Passive location tracking devices transmit their respective locations or their respective received GPS or other wireless signals to an intermediary device, such as a docking station, which, in turn, transmits such signals via wired or wireless communications to the remote location. Some location tracking devices may operate so as to be active at certain times and passive at other times.

Tracking devices can be used in a variety of applications in which attempts to interfere with the operation of the location tracking device are made. One such application where this situation arises is where the tracking device along with a remote monitoring center is used to track the location of an "offender", i.e., an individual who are part of a governmental program, such as parole or the like, wherein monitoring of the offender's location is required. Another application is the tracking of vehicles, such as delivery vehicles. In either application, the location tracking device is affixed to the entity to be monitored and generally can't be removed by other than authorized persons. Further, any attempt by an unauthorized persons to remove the tracking device or to disable its operation results in the transmission of an alarm signal to the remote monitoring station.

While existing tracking devices with these forms of tamper detection capability perform satisfactorily, they are unable to detect more subtle types of tampering which do not leave any permanent visible clues. For example, individuals have learned that the operation of a location tracking device can be thwarted by interfering with the device's ability to receive signals, e.g., GPS and/or other wireless signals, from which the location of the tracking device can be determined. One way of interfering with the signal-receiving capability of the location tracking device is to place signal-shielding material around the tracking device. Another way of accomplishing the same result is to utilize a signal-jamming device, i.e., a device that emits a jamming signal that extends across the frequency band of the GPS and/or other wireless signal from which the location of the tracking device can be determined. Because the signal magnitude of the jamming signal is substantially greater than that of the GPS or other wireless signal, the GPS or other wireless signal is "masked" or equivalently the signal receiver is shielded from properly receiving and processing these signals. The term "shielding" with respect to signals or tampering shall be used in this application to refer to the use of signal-shielding material and/or a signal jamming device to interfere with the operation of a location tracking device.

Signal shielding, if used on a permanent basis, will eventually create a reaction by the monitoring authorities. However, signal shielding is especially troublesome as it may be used temporarily. The shielding can be easily removed after placement about the tracking device and/or the jamming device can be turned off. In either case, there is no visual trace that either of these techniques have been used and there is no way to distinguish between temporary shielding and other non-tampering events, such as a temporary malfunction of the location tracking device or its temporary location in an area where GPS or other wireless signal reception is poor. Further, when shielding is temporarily used, it creates a window of opportunity during which the location of the monitored entity is unknown or not reliably known. Accordingly, it would be desirable if a mechanism could be devised for location tracking devices and systems that would distinguish between signal shielding and other plausible, unintentional non-tampering events.

SUMMARY OF THE INVENTION

In accordance with embodiments of the present invention, tamper detection capabilities for a location tracking system is enhanced through the utilization of circuitry within the location tracking device that detects signal shielding, i.e., activities that interfere with the ability of the location tracking device's ability to receive signals from which the location of the device can be determined. In accordance with one aspect of the present invention, a metal detection circuit is disposed in the location tracking device. A shielding indicator is then provided by examining the output of the detector circuit. Advantageously, the metal detection circuit is adapted to only detect the presence of metal within a small predetermined distance of the location tracking device. In accordance with another aspect of the present invention, the gain provided by an automatic gain control ("AGC") circuit in the GPS or other wireless signal receiver is examined and used to provide a shielding indicator. Preferably, with either aspect of the present invention, the generation of a false shielding alarm signal is reduced by transmitting a shielding alarm signal only if a predetermined number of shielding indicators are generated within a predetermined time period or if a shielding indicator persists for a predetermined time. These two described aspects of the present invention can advantageously be deployed individually or together in a tracking device. In addition, the present invention is applicable for use in smart or dumb location tracking devices which are active, passive or a combination of active and passive.

DETAILED DESCRIPTION

Figure 1:
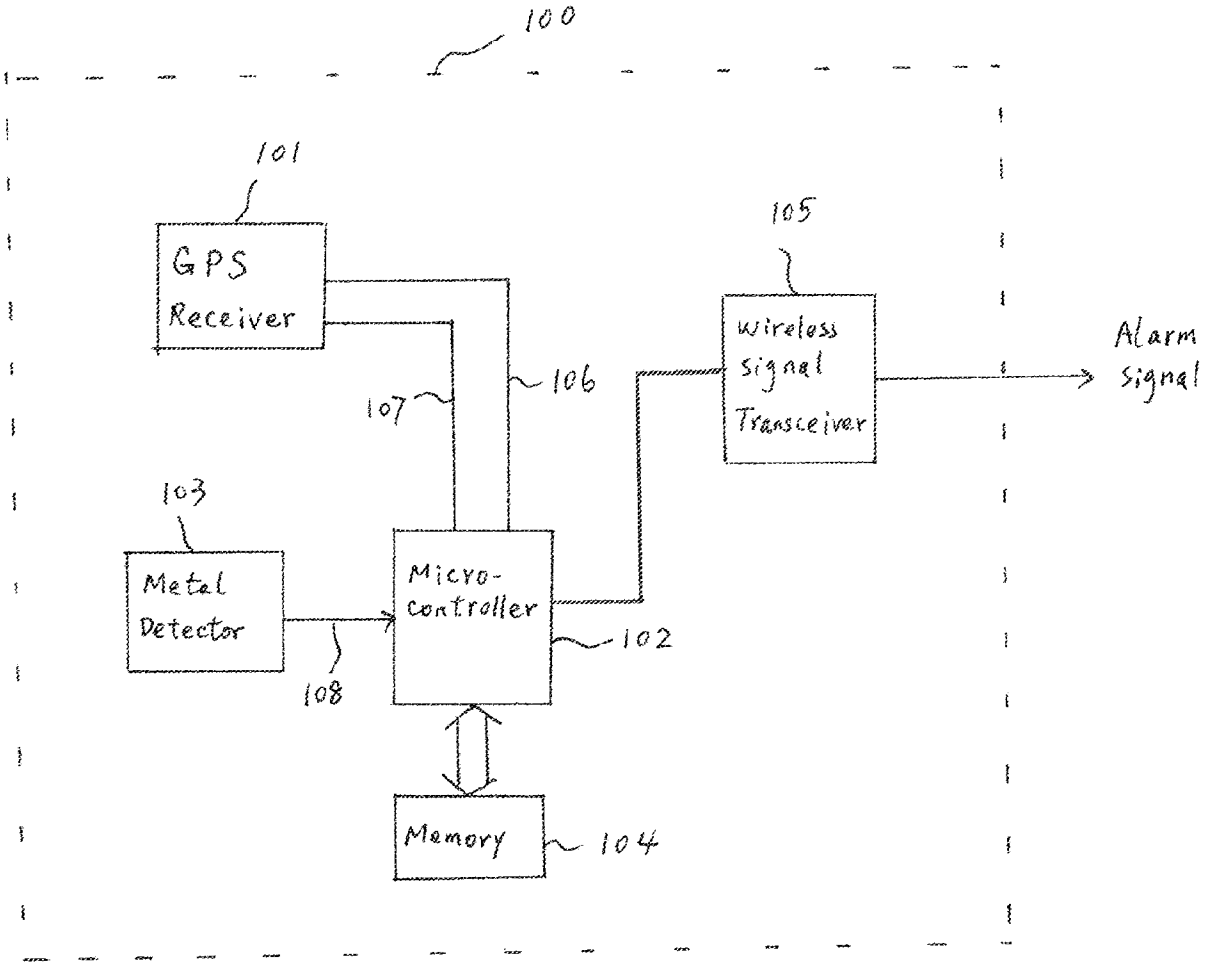
FIG. 1 is a block-schematic diagram of an illustrative embodiment of a location tracking device that utilizes the present invention.

Refer now to FIG. 1 which illustrates an illustrative location tracking device that incorporates an embodiment of the present invention. Tracking device 100, a portion of whose circuitry is shown in FIG. 1, is a commercially available one-piece, smart, active location tracking device. One such device is the BluTag® location tracking device that is commercially offered by Satellite Tracking of People LLC. The other portions of tracking device 100 that are not shown in FIG. 1 are not relevant to an understanding of the present invention. Device 100 may also any of the other forms of location tracking devices that are commercially available. If so and the location tracking device is one that is passive and not active, the shielding alarm signals that are generated in accordance with embodiments of the present invention and described below, would be transmitted by the docking station to the remote monitoring center when the location tracking device is in communication with the docking station.

Within device 100, conventional GPS receiver 101 receives GPS signals from which the location of device 100 is determined. GPS receiver 101 provides a signal having a predetermined level signal on lead 107 when receiver 101 is not receiving or is unable to properly decode a GPS signal. GPS receiver also provides a signal on lead 106 indicating the level of gain provided by an AGC circuit in GPS receiver 101. AGC circuits are routinely provided in GPS or other wireless signal receivers to maintain the level of the received GPS or other wireless signals within acceptable limits. The signals on leads 106 and 107 are coupled to microcontroller 102.

Location tracking device also incorporates a conventional metal detector 103 which provides an output signal on lead 108 when metal, such as tin foil or other ferrous or non-ferrous metal is detected. Detector 103 preferably utilizes the well-known two-coil amplitude modulation technique and also incorporates a trimmer so that only metal objects in a very close proximity to the tracking device, e.g., 2 or 3 cm, are detected. Location tracking device 100 also includes a memory 104 and a signal transceiver 105, the latter for communicating with a remote monitoring center.

Figure 2:
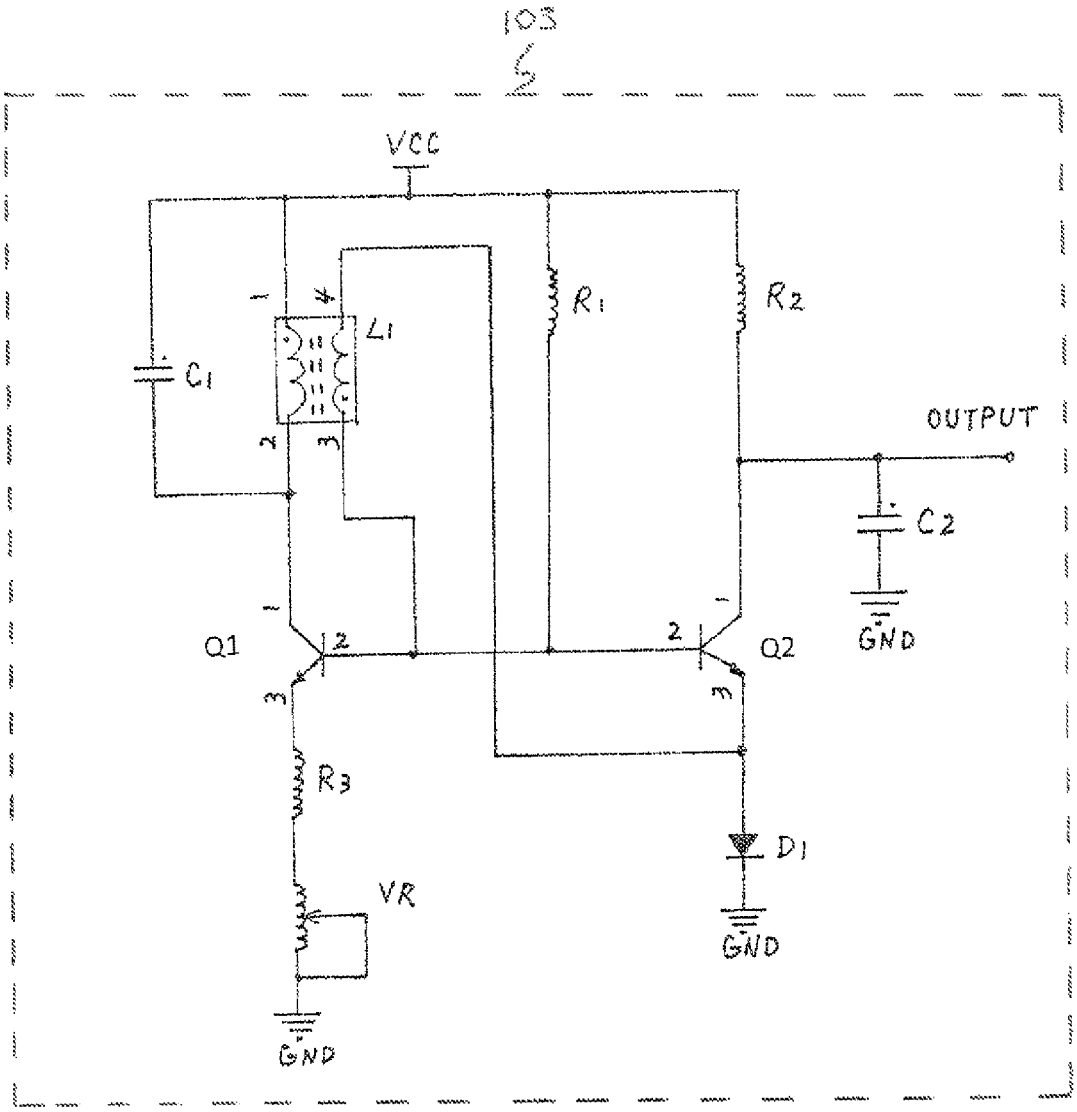
FIG. 2 is a block-schematic diagram of a metal detector suitable for use in FIG. 1.

FIG. 2 illustrates an exemplary circuit for providing metal detector circuit 103. This exemplary circuit includes fixed resistors R1, R2 and R3, variable resistor VR, transistors Q1 and Q2, diode D1, capacitors C1 and C2, and inductor L1. Referring to FIG. 2, capacitor C1, inductor L1 and transistor Q1 form an oscillator. Inductor L1 is a coil of two windings around a ferrite core. The amplitude of oscillation provided by the circuitry of FIG. 2 can be adjusted using the potentiometer YR. The oscillation from feedback in L1 also appears across the base-emitter junction of Q2. The DC output voltage will vary with the amplitude of the base oscillation if it is above the base threshold of Q2. The circuitry shown is normally set up with VR adjusted so the amplitude of oscillation is sufficiently high enough to switch on Q2 consistently. Introducing foil within the vicinity of the coil changes the inductance and hence the amplitude of oscillation. This is detected at the output.

Figure 3:
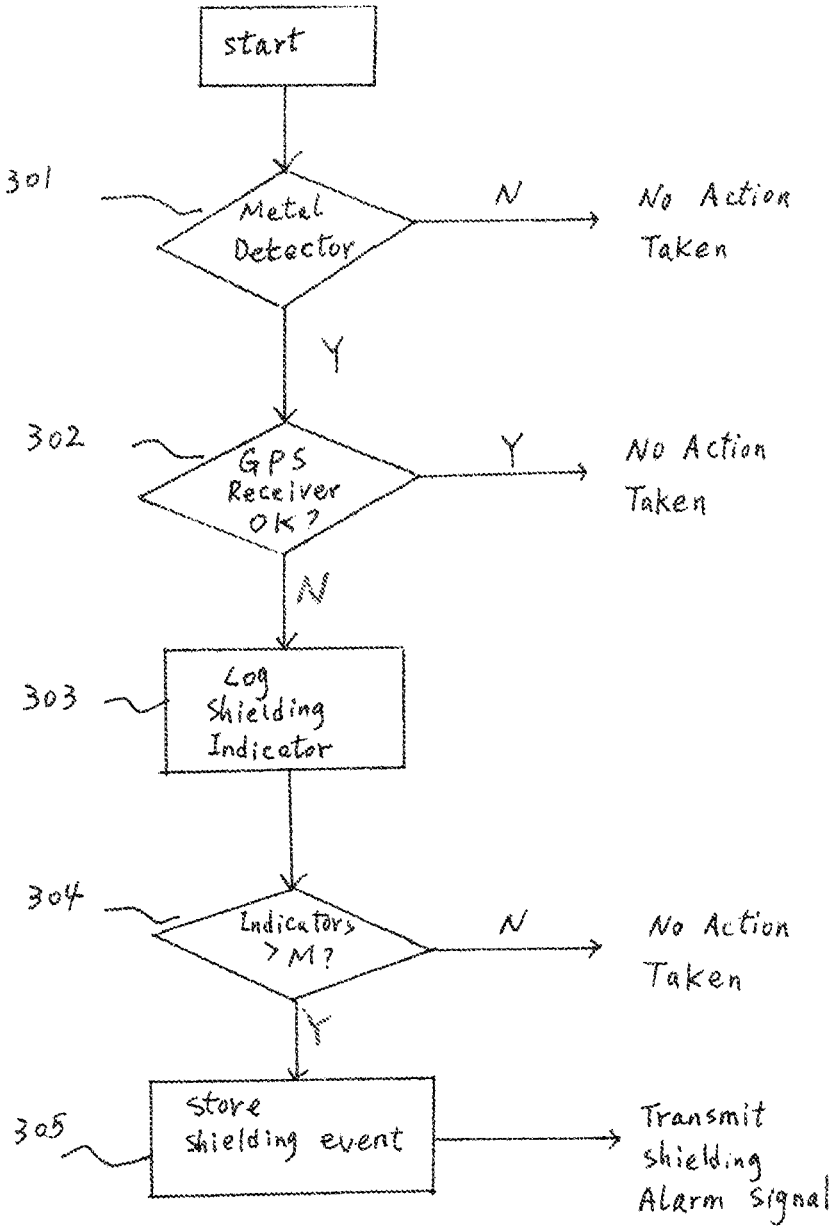
FIG. 3 is an illustrative flow chart of the processing carried out by the microcontroller of FIG. 1 in accordance with the first aspect of the present invention.

Refer now to FIG. 3 which illustrates the steps carried out by the microcontroller to process the output signal on lead 108 provided by metal detector circuit 103. At step 301, microcontroller determines whether metal has been detected by detector 103 by examining the signal level on lead 108. Illustratively, the signal level on lead 108 goes high when metal has been detected and is low otherwise. If metal has not been detected by detector 103, no action is taken. If this is not the case, then processing proceeds to step 302 wherein the signal level on lead 107 is examined. If the signal level on lead 107 indicates proper operation of GPS receiver 101, the processing returns to the beginning. However, if the signal level on lead 107 indicates that GPS receiver 101 is not able to properly process GPS signals—that is either no GPS signals are being received or that their information content is unintelligible, the processing proceeds to step 303. At step 303, a tampering indicator is logged and a count of the cumulative number of such count of such indicators is incremented by 1. In maintaining a count, it has been assumed that the process of FIG. 3 is repeated at predetermined time intervals and reset after a number of such intervals. Alternatively, the process of FIG. 3 may be performed continuously and, if so, the time duration that the tampering indicator persists can be measured. At step 304, the count of tamper indications or the time duration of this indicator is compared to an associated threshold M. If this threshold is exceeded, a shielding alarm is stored in memory 104 and, preferably, along with the date and time of this event. In addition, a shielding alarm signal is coupled to transmitter 105 for transmission to the remote monitoring center. If transmission to the remote transmission center is not possible due to shielding, a record of this activity is maintained in memory. In addition, attempts to transmit the shielding alarm signal may be repeated until an acknowledgment signal from the remote monitoring center is received by signal transceiver 105 indicating successful receipt of the shielding tamper alarm. If the count or the duration of the tamper indicator is less than M, no shielding alarm signal is transmitted.

Figure 4:
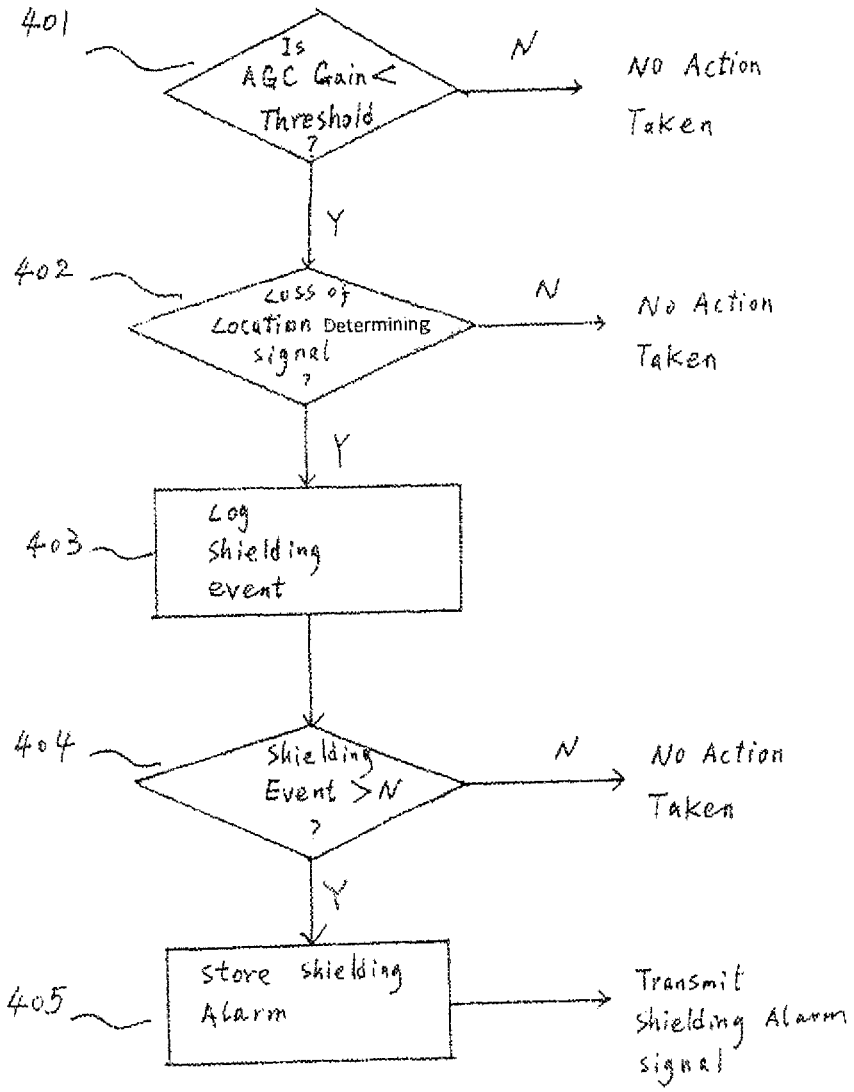
FIG. 4 is a flow chart of the processing illustrative now chart of the processing carried out by the microcontroller of FIG. 1 in accordance with the second aspect of the present invention.

FIG. 4 shows the processing performed to detect whether there has been shielding via the use of a signal jamming device. At step 401, the signal level on lead 106 is provided to a comparator (not shown in FIG. 1) that compares this signal level to a predetermined threshold. This threshold is such that in the absence of signal jamming, the threshold is normally exceeded. When this threshold is not exceeded, indicating that the amount of gain provided by the AGC circuit is less than what is expected, processing proceeds to step 402. If the predetermined threshold is exceeded, no action is taken.

At step 402, the signal level on lead 107 is examined to determine whether GPS receiver 101 is operating properly. If it is, no action is taken. If it is not, then processing proceeds to step 403 wherein a possible shielding tamper event is logged, preferably along with its date and time. The cumulative count of the number of such events is also maintained or the duration of this event is monitored. At step 404, this cumulative count or duration is compared to a predetermined threshold N and until this threshold is exceeded, no action is taken. Once this threshold is exceeded, processing proceeds to step 405 wherein a shielding alarm is stored. In addition, transceiver 105 is directed to transmit a shielding alarm signal to the remote monitoring center. This alarm signal is preferably repeated until transceiver 105 receives an acknowledgement signal from the remote monitoring center indicating successful receipt of the shielding alarm signal.

The shielding indications that are logged and the shielding alarms that are transmitted in accordance with the first and second aspects of the present invention may be distinct from one another so that shielding via the use of signal shielding material can be distinguished from the use of a signal jamming device.

During an alarm, the unit could also indicate via audible or visual cues to the offender that the unit is in this condition.

It should, of course, be understood that while the present invention has been disclosed in reference to specifically described embodiments, numerous alternatives will be apparent to those of ordinary skill in the art without departing from the spirit and scope of the present invention. For example, while both shielding and jamming tampering is detected by the illustrative location tracking device, each of these tampering detecting techniques are independent of one another and may be used alone. Further, while in the disclosed embodiment, a shielding alarm signal is not transmitted by the location tracking device to the remote monitoring center until an associated threshold is exceeded, this threshold, designated as M and N may be the same or different and either one or both of these thresholds may be set to one. When set to one, a single shielding indicator causes a shielding alarm to be stored and transmitted. Finally, while embodiments of the present invention has been described with respect to the shielding of GPS signals, embodiments of the present invention is also applicable to detecting shielding of other wireless signals, such as cellular so that the present invention location tracking devices that receive other wireless signals, such as cellular, either alone or along with GPS to determine the location of the tracking device. In such devices, the signals from a wireless signal receiver in the location tracking device that are analogous to those on leads 106 and 107 can be used in lieu of or along with these signals to implement the first and second aspects of the present invention. That is, the processing shown in FIGS. 3 and 4 can be implemented for such analogous signals as they are the signals on leads 106 and 107.

I claim:

1. An improved location tracking device of the type having one or more receivers wherein each receiver receives associated signals at different times from which the device generates data representative of the location of the tracking device at such different times and wherein each receiver has associated first control circuitry for providing varying levels of gain, the improvement comprising (i) a metal detector disposed in the location tracking device, said detector being tuned to detect metal provided it is within close proximity of the device and wherein said metal detector is used to generate an indication of a first form of tampering with the operation of the location tracking device and (ii) second circuitry disposed in the location tracking device that analyzes the gain provided by said first circuitry and wherein said second circuitry is used to generate an indication of a second form of tampering with the operation of the location tracking device.

2. The location tracking device of claim 1 wherein the first form of tampering involves use of signal shielding material and the second form involves use of a signal jamming device.

3. The location tracking device of claim 1 wherein the device generates an indication of the first form of tampering based on (a) whether the receiver is receiving the associated signals unimpeded, and (b) whether the metal detector detects metal.

4. The location tracking device of claim 1 wherein the second circuitry generates said indication of the second form of tampering based on whether the receiver is receiving the associated signals unimpeded.

5. The location tracking device of claim 3 wherein a shielding alarm signal is generated if the indication of the first form of tampering occurs a predetermined number of times in a predetermined time interval.

6. The location tracking device of claim 5 further including a transmitter for transmitting the shielding alarm signal to a remote location.

7. The location tracking device of claim 6 wherein the location tracking device includes a memory to log the occurrence of the shielding alarm signal if the transmitter is unable to transmit this signal to the remote location.

8. The location tracking device of claim 6 wherein the transmitter repeatedly transmits the shielding alarm signal to the remote location until an acknowledgement signal is received from such location.

9. The location tracking device of claim 1 wherein the one or more receivers includes a GPS receiver.

10. The location tracking device of claim 9 wherein the second circuitry in each receiver compares the gain provided by such first control circuitry to a predetermined threshold.

11. The location tracking device of claim 1 wherein the one or more receivers includes a wireless signal receiver.

12. The location tracking device of claim 11 wherein the second circuitry in each receiver compares the gain provided by such first circuitry to a predetermined threshold.

13. A method for countering attempts to thwart the operation of a location tracking device that generates data representative of its location at different times in response to signals received by a signal receiver, said method comprising the steps of:

providing a metal detector in the location tracking device configured to detect metal only if it is within close proximity of the device and providing an output signal indicating such detection; and generating a signal shielding alarm signal if the output signal meets prescribed criteria.

14. A method for countering attempts to thwart the operation of a location tracking device that generates data representative of the location of the location tracking device at different times in response to signals received by a receiver having associated gain control circuitry, said method comprising:

providing circuitry that analyzes the gain provided by said gain control circuitry to determine if a signal jamming device is interfering with the operation of that receiver;

monitoring a duration of the corresponding interference; and wirelessly transmitting a signal jamming alarm signal when the duration exceeds a non-zero predetermined threshold;

wherein the signal jamming alarm signal is not transmitted when the duration is below the non-zero predetermined threshold.

15. A location tracking apparatus, comprising:

a receiver configured to receive external signals and determine an approximate location of the apparatus from the external signals;

a metal detector configured to detect metal only if it is within close proximity of the apparatus;

a processor configured to generate an alarm signal in response to an attempt to block the receiver from receiving the external signals by at least partial encasement of the apparatus in metal, based on at least the metal detector detecting metal; and a wireless transmitter configured to transmit an alarm notification responsive to the alarm signal.

16. The apparatus of claim 15, wherein:

the processor is configured to log the duration of time that metal is detected or a count of times that metal is detected; and the processor is configured to generate the alarm signal in response to the count or the duration exceeding a predetermined threshold.

17. A method for responding to a location tracking apparatus being subjected to interference, comprising:

receiving external signals from which an approximate location of the apparatus can be determined;

detecting the presence of metal within close proximity of the apparatus;

generating an alarm signal in response to an attempt to block the apparatus from receiving the external signals by at least partial encasement of the apparatus in metal, based on at least detecting metal; and transmitting an alarm notification responsive to the alarm signal.

18. The method of claim 17, further comprising:

logging the duration of time that metal is detected or a count of times that metal is detected;

wherein the generating comprises generating the alarm signal in response to the count or the duration exceeding a predetermined threshold.

19. A location tracking apparatus, comprising:

a receiver configured to receive external signals and determine an approximate location of the apparatus from the external signals, the receiver having gain control circuitry;

a processor configured to:

analyze a gain from the gain control circuitry;

determine, as a result of the analyzing, whether the gain is below a first threshold;

monitor a duration of the gain being below the first threshold;

generate an alarm signal in response to the duration exceeding a non-zero predetermined threshold; and a wireless transmitter configured to transmit an alarm notification responsive to the alarm signal;

wherein the alarm signal is not generated when the duration is below the non-zero predetermined threshold.

20. The apparatus of claim 19, wherein the alarm signal represents a possible attempt to block the receiver from receiving the external signals by at least signal jamming.

21. A method for responding to jamming of a location tracking apparatus, comprising:

receiving, via a receiver, external signals from which an approximate location of the apparatus can be determined;

analyzing a gain from the receiver;

determining, as a result of the analyzing, whether the gain is below a first threshold;

monitoring a duration of the gain being below the first threshold;

generating an alarm signal in response to the duration exceeding a non-zero predetermined threshold; and wirelessly transmitting an alarm notification responsive to the alarm signal;

wherein the alarm signal is not generated when the duration is below the non-zero predetermined threshold.

22. The method of claim 21, wherein the alarm signal represents a possible attempt to block the receiver from receiving the external signals by at least signal jamming.

23. A method for countering attempts to thwart the operation of a location tracking device that generates data representative of the location of the location tracking device at different times in response to signals received by a receiver having associated gain control circuitry, said method comprising:

providing circuitry that analyzes gain provided by said gain control circuitry to determine if signal jamming is interfering with the operation of that receiver;

monitoring a count of the number of times interference is detected; and wirelessly transmitting a signal jamming alarm signal when a duration or count exceeds a predetermined threshold;

wherein the predetermined threshold is a non-zero threshold, and wherein the signal jamming alarm signal is not transmitted when the count is below the non-zero predetermined threshold.

24. A location tracking apparatus, comprising:

a receiver configured to receive external signals and determine an approximate location of the apparatus from the external signals, the receiver having gain control circuitry;

a processor configured to:

analyze gain from the gain control circuitry;

determine, as a result of the analyzing, whether the gain is below a first threshold;

monitor a count of the number of times the gain is below the first threshold in a time period;

generate an alarm signal in response to the count exceeding a predetermined threshold; and a wireless transmitter configured to transmit an alarm notification responsive to the alarm signal;

wherein the predetermined threshold is a non-zero threshold, and wherein the alarm signal is not generated when the count is below the predetermined threshold.

25. The apparatus of claim 24, wherein the alarm signal represents a possible attempt to block the receiver from receiving the external signals by at least signal jamming.

26. A method for responding to jamming of a location tracking apparatus, comprising:

receiving, via a receiver, external signals from which an approximate location of the apparatus can be determined;

analyzing a gain from the receiver;

determining, as a result of the analyzing, whether the gain indicates that the external signals are being jammed;

monitoring a count of the number of times the determining determines within a time period that the gain indicates that the external signals are being jammed;

generating an alarm signal in response to the count exceeding a predetermined threshold; and wirelessly transmitting an alarm notification responsive to the alarm signal;

wherein the predetermined threshold is a non-zero threshold, and wherein the alarm notification is not transmitted when the count is below the non-zero predetermined threshold.

* * * * *